United States Patent [19]

Price et al.

[11] Patent Number: 4,504,998

[45] Date of Patent: Mar. 19, 1985

[54] HUMAN HAIR-GROOMING DEVICE

[76] Inventors: Vera H. Price, 964 Shattuck Ave., Berkeley, Calif. 94707; Emory Menefee, 5313 Rosalind Ave., Richmond, Calif. 94805

[21] Appl. No.: 422,865

[22] Filed: Sep. 24, 1982

[51] Int. Cl.[3] ..... A46B 9/02

[52] U.S. Cl. ..... 15/186; 15/159 A; 132/85

[58] Field of Search ..... 15/159 R, 159 A, 186, 15/187, 188; 132/112, 120, 85, 126, 142, 159

[56] References Cited

U.S. PATENT DOCUMENTS

| | | | |
|---|---|---|---|
| 1,497,036 | 6/1924 | Skoglund | 15/159 R X |
| 1,820,768 | 8/1931 | Barker | 132/142 X |
| 2,607,064 | 8/1952 | Sullivan et al. | 15/187 |
| 3,087,223 | 4/1963 | Raw | 132/85 X |
| 3,538,617 | 11/1970 | Walters | 119/93 X |
| 4,167,794 | 9/1979 | Pomeroy | 15/188 |

FOREIGN PATENT DOCUMENTS

| | | | |
|---|---|---|---|
| 954436 | 6/1949 | France | 132/126 |
| 2980 | of 1895 | United Kingdom | 15/159 A |

*Primary Examiner*—Peter Feldman

[57] ABSTRACT

A hair-grooming device for humans is disclosed. The device comprises a plurality of hair-engaging elements retainably mounted in a base, each element having a rounded end and a distortion with respect to the axis of the element along its length. Mechanical damage to human hair is greatly reduced by the use of the present device.

1 Claim, 4 Drawing Figures

HUMAN HAIR-GROOMING DEVICE

FIELD OF THE INVENTION

This invention relates to and has among its objects the provision of novel human hair-grooming devices. It is a particular object of the invention to provide a hair-grooming device that minimizes damage to the human hair being groomed. Further objects of the invention will be evident from the following description.

DESCRIPTION OF PRIOR ART

Scanning electron microscopy has been applied to the study of human hair, particularly with respect to the effects of cosmetic treatments such as combing, brushing, and the like on hair subjected to such treatments (Brown, et al., J. Soc. Cosmet. Chem., 26 289–297 (1975); Swift, et al., J. Soc. Cosmet. Chem., 23 695–702 (1972); Bottoms, et al., Brit. J. Derm., 86 379–384 (1972); and Robinson, J. Soc. Cosmet. Chem., 27 155–161 (1976)). It has been found that the aforementioned cosmetic treatments in time lead to mechanical damage to hair, in particular causing the wearing down and ultimate loss of cuticle scales from root to tip. Subsequent to the loss of the outer protective cuticle, the underlying hair cortex is subject to mechanical gouging and eventual breakage from continued grooming practices. The mechanical damage described above adversely affects the shine, feel, and the physical and chemical behavior of hair. This damage to hair is irreversible, that is, the damaged portion cannot be restored by subsequent treatments to its original condition.

Human hair-grooming devices that have been used in the past produce deleterious effects on hair for a number of reasons. To be effective in grooming, many hair brushes, for example, have a great many closely grouped bristles. Hair becomes caught between the closely grouped bristles, necessitating the application of excessive force to move the brush through the hair. This excessive force has the effect of damaging hair as mentioned above. The force required is increased also because of the friction between the hair and the bristles. Another disadvantage of prior art brushes is the texture of the bristle ends. Synthetic bristles are cut to size in such a way as to leave sharp and sometimes jagged ends that can chip the surface of the hair. Natural boar bristles have rough, irregular, knobby ends that also may cause damage to the hair. The force required in the use of the prior art brushes intensifies the aforementioned effects.

Carding is a process that takes place as an early stage in the processing of most of the natural fibers. For example, wool, cotton, flax tow, and jute are all carded. The purpose of carding is to disentangle fibers. To achieve this, the fibers are pulled apart and oriented by being drawn between two oppositely rotating cylinders with teeth made of metal wires whose ends have been ground to a sharp tip to facilitate penetration into the passing fiber mass. These wire teeth have a bent shape to facilitate both penetration into the fiber mass and spilling out of entangled fibers before excessive breakage occurs. (Wool Sci. Rev., 9 3–14 (1952); Griffin, "Practical Worsted Carding," The National Trade Press, Ltd., London, 1957, pp. 146–159). Veterinary brushes have been manufactured with sharp wire teeth similar to those found in the carding apparatus.

SUMMARY OF THE INVENTION

The invention described herein provides means for overcoming the disadvantages of the human hair-grooming devices of the prior art. The human hair-grooming devices of the present invention comprise a plurality of hair-engaging elements retainably mounted in a base, each element having a rounded end and a distortion along its length with respect to the axis of said element. Arrangement of elements on the base, their shape, size, and composition, are designed for minimal breakage and damage of human hair when the hair-grooming device is passed through hair.

The primary advantages of the hair-grooming device of the invention is that the operation of grooming can be accomplished with minimal mechanical damage to the hair. Because of the shape, rounded ends, composition, and arrangement of the grooming elements of the device, it provides a quality of grooming equivalent to that of prior art brushes, but with a large reduction in the force needed to move the grooming device through the hair, thereby causing less mechanical damage. Thus, the hair will retain its shine and feel, and its desirable physical and chemical properties. An additional advantage of the rounded ends of the grooming elements is that they cause minimal damage and irritation to the scalp.

DESCRIPTION OF THE PREFERRED EMBODIMENTS

Figure 2:
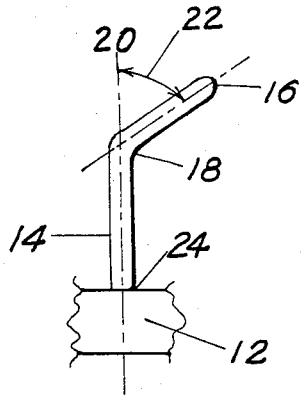
FIG. 2 is a front view of a single hair-engaging element of the invention.
Figure 3:
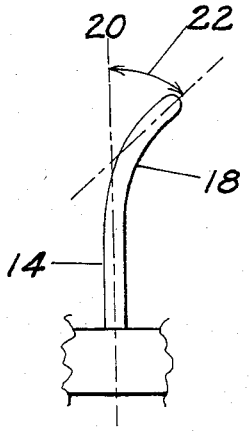
FIG. 3 is a front view of another embodiment of a single hair-engaging element of the invention.
Figure 1:
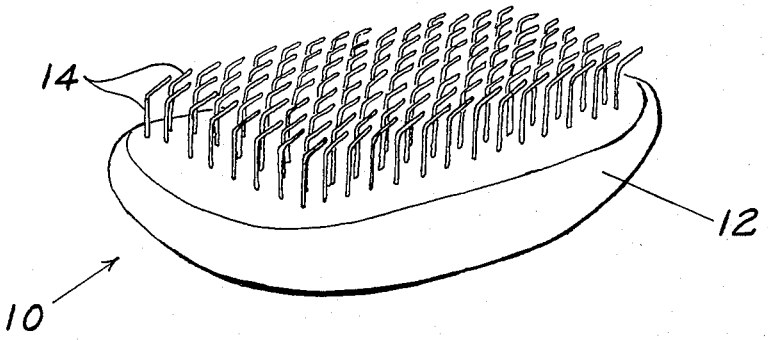
FIG. 1 is a perspective view, seen at an angle from the top of one embodiment of the present invention.

The invention will next be described in detail with reference to the accompanying drawings. FIG. 1 depicts hair-grooming device 10 (in this instance a brush), comprising base 12, which also acts as a handle. Fixedly or retainably mounted in base 12, preferably aligned in parallel or staggered rows, are a plurality of hair-engaging elements (or bristles) 14. Elements 14, more particularly shown in FIG. 2, are usually thin and cylindrically shaped, or otherwise shaped to minimize frictional interaction with the hair. Each of elements 14 has a rounded end 16 and longitudinal distortion 18 with respect to its axis 20. Elements 14 are oriented with respect to each other such that hair to be groomed is urged through the elements in one direction. The urging of hair through elements 14 also tends to pull device 10 toward the root of the hair, ultimately stopping at the scalp. It is important to note that the present device will not be effective if the hair-engaging elements are randomly oriented with respect to one another. Generally, satisfactory grooming results can be achieved if longitudinal distortion 18, which may be either a bend (FIG. 2) or a curve (FIG. 3), is at an angle 22 of about 45 degrees from axis 20, although this angle is given for illustration and not by way of limitation.

Elements 14 are formed from a suitable material having low frictional surface interaction with the hair to be groomed, and having a rounded end. A preferred material also has minimal ability to produce electrostatic charge during the grooming operation. Materials from which elements 14 can be manufactured are, by way of example and not limitation, plastics such as polypropylene, polyamides, Teflon ®, and Delrin ®, smooth metals, composite materials such as metals coated with plastics to provide a stiff and resilient support for the less stiff but more desirable polymeric coating, and the like. The length and width of elements 14 are chosen to facilitate the function of 10 as a human hair-grooming device. Usually, elements 14 will be about 1 to 3 cm in length, and about 0.3 to 2 mm in width. The position of distortion 18 along axis 20, particularly an angular distortion as in the case of a bend, may vary from about 0.5 to 2.5 cm from the point of attachment 24 of elements 14 in base 12. It should be realized that distortion 18 may occur at any position along axis 20 which position would enable hair to be groomed. Each distortion of elements 14 is oriented with respect to the other such that the movement of the hair-grooming device through the hair is facilitated. In this respect it is important that each distortion be oriented substantially in the same direction as the other distortions. If the orientations are different for each distortion, the benefits of the device will be realized to a lesser degree or not at all.

Base 12 can be formulated from a suitable material such as plastic, rubber, wood, and the like, by way of example and not limitation. In a preferred embodiment of the invention, the material from which the base is formed and the material from which the elements 14 are formed are chosen so that the device exhibits flexibility during its use. In other words, elements 14 can be formed from material of low flexibility as long as the material of base 12 allows proper flexing of the device. On the other hand, the material of base 12 may have low flexibility if elements 14 are made of flexible material. Lack of flexibility of the device of the invention is not desirable since mechanical damage could thereby be inflicted on the human hair during the grooming operation. In a preferred embodiment of the invention, as exemplified by FIG. 1, it is desirable that most of the flexibility of the device is exhibited by elements 14. This is because one of the functions of angular distortion 18 in element 14, besides facilitating hair engagement, is to bend and allow release of entangled hair before grooming stresses become large enough to cause breakage.

Figure 4:
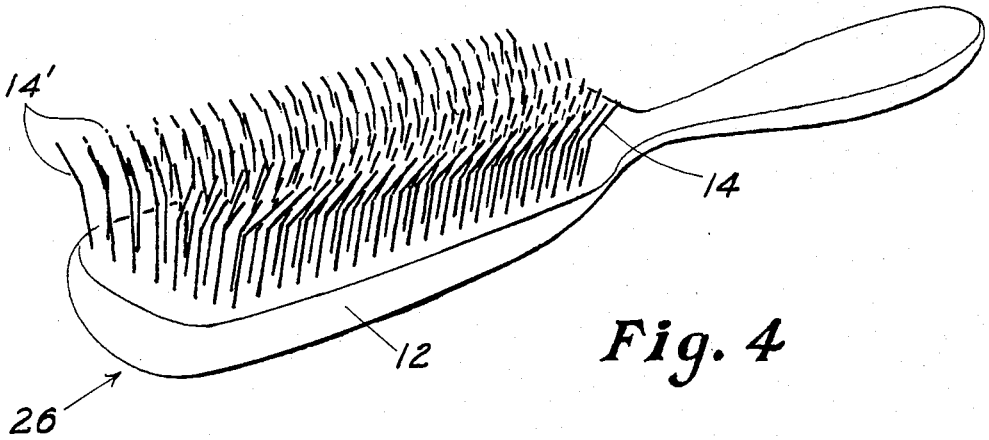
FIG. 4 is a perspective view, seen at an angle from the top, of another embodiment of the invention.

Another embodiment of the present invention is illustrated in FIG. 4. The device 26 depicted is similar to the device of FIG. 1, with the important added feature of rows of elements 14', wherein the distortions or bends are oriented oppositely to the distortions or bends of the corresponding rows of elements 14, such that the rows of 14' form a mirror image of the rows of 14. Preferably, the number of rows of elements 14' are equal to the number of rows of elements 14. Hair-grooming device 26 may be used in two directions instead of one as a result of the two opposite orientations of the distortions.

What is claimed is:

1. A human hair grooming device comprising a plurality of hair-engaging elements retainably mounted in a base which are aligned in rows along the length and width of the base, each element being characterized as having (1) a rounded end, (2) an overall length of from approximately 1 to 3 cm, (3) a cross sectional width of from approximately 0.3 to 2.0 mm, and (4) a single positional distortion along its axis from approximately 0.5 to 2.5 cm from its point of attachment to said base, wherein the distortions in approximately half of the rows of said hair-engaging elements are oriented oppositely to the distortions in the remaining rows of said hair engaging elements and wherein said base and hair-engaging elements, taken together, are of a sufficient flexibility to allow release of entangled hair before grooming stresses become large enough to cause hair breakage.

* * * * *